US009519233B2

(12) United States Patent
Srinivasan

(10) Patent No.: US 9,519,233 B2
(45) **Date of Patent: *Dec. 13, 2016**

(54) TONER FORMULATIONS HAVING IMPROVED TONER USAGE EFFICIENCY AND METHOD TO MAKE THE SAME

(71) Applicant: Lexmark International, Inc., Lexington, KY (US)

(72) Inventor: Kasturi Rangan Srinivasan, Longmont, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/580,864

(22) Filed: Dec. 23, 2014

(65) Prior Publication Data

US 2015/0234300 A1 Aug. 20, 2015

Related U.S. Application Data

(63) Continuation of application No. 14/180,411, filed on Feb. 14, 2014, now Pat. No. 9,217,939.

(51) Int. Cl.

| | |
|---|---|
| ***G03G 9/08*** | (2006.01) |
| ***G03G 9/097*** | (2006.01) |
| ***G03G 9/087*** | (2006.01) |

(52) U.S. Cl.

CPC ..... *G03G 9/0802* (2013.01); *G03G 9/081* (2013.01); *G03G 9/0808* (2013.01); *G03G 9/0819* (2013.01); *G03G 9/08711* (2013.01); *G03G 9/08755* (2013.01); *G03G 9/09708* (2013.01); *G03G 9/09716* (2013.01); *G03G 9/09725* (2013.01)

(58) Field of Classification Search

CPC ..... G03G 9/0819; G03G 9/09716; G03G 9/09725

USPC ..... 430/137.21, 108.3, 108.7

See application file for complete search history.

(56) References Cited

U.S. PATENT DOCUMENTS 9,217,939 B2 * 12/2015 Srinivasan ..... G03G 9/0819

* cited by examiner

*Primary Examiner* — Mark A Chapman

(57) ABSTRACT

A toner composition and a method of making a toner composition wherein toner particles having an average size in the range of 1-25 μm may be mixed with large fumed silica particles sized 70 nm to 120 nm and medium fumed silica particles sized 30 nm to 60 nm and optionally alumina particles surface treated with an inorganic/organic compound. The large sized fumed silica particles are present in the range of 0.1% to 2% by weight of the toner composition. The medium sized fumed silica particles are present in the range of 0.1% to 2% by weight of the toner composition. The alumina particles surface treated with an inorganic/organic compound may be present in the range of 0.01% to 1.0% by weight of the toner composition.

16 Claims, No Drawings

TONER FORMULATIONS HAVING IMPROVED TONER USAGE EFFICIENCY AND METHOD TO MAKE THE SAME

CROSS REFERENCES TO RELATED APPLICATIONS

This application is related to U.S. patent application Ser. No. 14/180,411, entitled "TONER FORMULATIONS HAVING IMPROVED TONER USAGE EFFICIENCY AND METHOD TO MAKE THE SAME", filed on Feb. 14, 2014 and assigned to the assignee of this application.

STATEMENT REGARDING FEDERALLY SPONSORED RESEARCH OR DEVELOPMENT

None.

BACKGROUND

1. Field of the Invention

The present invention relates generally to an improved toner composition and method to make the toner using specific types of silica as extra particulate additives wherein the toner formulation generates less toner waste, increases toner usage efficiency and significantly reduces toner consumption without impacting image quality and charge characteristics.

2. Description of the Related Art

Toner may be utilized in image forming devices, such as printers, copiers and/or fax machines to form images upon a sheet of media. The image forming apparatus may transfer the toner from a reservoir to the media via a developer system utilizing differential charges generated between the toner particles and the various components in the developer system. Control of flow properties may be achieved by dry toner surface modification and the attachment or placement of fine particles, or extra-particulate additives on the surface of the particles. Moreover, decrease in overall toner usage by the consumer is an important concern to the consumer in terms of a cost and environmental standpoint.

SUMMARY OF THE INVENTION

An aspect of the present disclosure relates to a toner composition which may used in an electrophotographic printer or printer cartridge. This toner formulation generates less toner waste, increases toner usage efficiency and significantly reduces toner consumption without impacting image quality and charge characteristics. The toner composition comprises toner particles having an average size in the range of 1-25 μm that may be mixed with a specific mixture of silicas—namely a first fumed silica having a primary particle size of about 30 nm-50 nm and a second fumed silica having a primary particle size of 70 nm-80 nm. The reduction in toner consumption relates to a decrease in toner-to-cleaner or waste toner. This translates into an environmentally desirable need for less cartridge manufacturing, less toner waste, reductions in paper consumption as well as significant savings in terms of cost of printing per page. Moreover toner consumption is reduced without affecting the overall print quality. The first silica particles used have an average primary particle size in the range of 30 nm to 50 nm, preferably 40 nm and may be present in the range of 0.01% to 3.0% by weight of the toner composition. The second fumed silica particles used have an average primary particle size in the range of 70 nm-80 nm and may be present in the range of 0.01% to 2.0% by weight of the toner composition.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

BACKGROUND

Electrophotographic printers and cartridges typically use either a mechanically milled toner or a chemically prepared toner ('CPT'). Chemically prepared toner can be a toner derived from using a suspension polymerization method, an emulsion agglomeration ('EA') method, or an aggregation method. Independent of the method of preparation, toner flow properties and print quality metrics can be suitably manipulated by use of extra particulate additives ('EPA's) to the toner particle surface. EPAs help improve the toner flow behavior, lower or eliminate the tendency to brick or cake under high temperature and/or humidity, improve transfer of toner from a photoreceptor to paper or an image transfer member, transfer between an image transfer member and paper, or regulate the toner charge across various environments (ie, varying temperature and humidity) and improve print quality.

Whereas most of the toner formulation is printed on a document, a small amount of toner is lost as waste. Hence there is a desire to minimize waste toner and therefore maximize the toner usage efficiency. Toner usage efficiency is described as the ratio of toner on a printed page to total toner used. Similarly, waste toner will be herein after referred to as "toner in the cleaner" or "toner-to-cleaner (TTC)".

Several EPAs have been employed in the surface treatment of toner. These EPAs include various inorganic oxides such as silicon dioxide also known as silica, titanium dioxide also known as titania, aluminum oxide, and composite mixtures of titania, silica and/or alumina. Further metal soaps have also been used to improve the transfer efficiency of a toner.

Inorganic oxides may be obtained using a fuming process or a colloidal process. Fumed silica, also known as pyrogenic silica, is produced in a flame. This type of silica consists of microscopic droplets of amorphous silica fused into branched, chainlike, three-dimensional secondary particles which then agglomerate into tertiary particles. In a typical case, fumed silica is produced by pyrolysis of silicon tetrachloride.

Inorganic oxides such as silica, titania, alumina etc., can vary in their primary particle size from about a 5 nm to several micrometers. Moreover to achieve uniform print quality across different type of environments, inorganic oxides are surface treated with various treatments such as organosilanes and silicone oil. The extent of surface treatment of the hydroxyl groups in an inorganic oxide can also be varied. In regards to the primary particle size of then silica, the toner flow can be significantly improved by use of a smaller primary particle size silica, usually about 5 nm-15 nm in combination with a large primary particle size such as 40 nm-250 nm. This larger sized silica serves as a useful 'spacer'. Spacers are effective in keeping individual toners apart and hence can improve the storage stability. Silicas with a primary particle size of about 100 nm has been used in CPT toners to be effective spacers. The large silica described as a spacer is typically prepared by a sol-gel or colloidal process. Whereas the medium size silica, about 30 nm-60 nm primary particle size help with toner flow, they are ineffective spacers, and the large silica while functioning as a spacer requires to be used at higher concentrations or levels to help with toner flow. Hence there is a need for a silica that can help both with toner flow and also act as a suitable spacer between surface treated toner particles.

The inventor has discovered that the use of 60 nm-100 nm fumed silica, more preferably a 70 nm-80 nm silica, prepared from a fuming process the helps impart the needed optimum spacer behavior and significantly improves the toner usage efficiency, thereby resulting in a lower toner-to-cleaner or waste toner. Having this optimum spacing behavior generates a toner formulation having less toner waste, increases toner usage efficiency and significantly reduces toner consumption without impacting image quality and charge characteristics.

The present disclosure is directed at a toner formulation which generates less toner waste, increases toner usage efficiency and significantly reduces toner consumption without impacting image quality and charge characteristics by providing extra particular agents including a specific mixture of silicas—namely a first fumed silica having a primary particle size of about 30-50 nm and a second fumed silica having a primary particle size of 70 nm-80 nm to the toner, and in particular, to the toner particle surface. The toner particles may be prepared by a chemical process, such as suspension polymerization or emulsion aggregation. In one example, the toner particles may be prepared via an emulsion aggregation procedure, which generally provides resin, colorant and other additives. More specifically, the toner particles may be prepared via the steps of initially preparing a polymer latex from vinyl type monomers, such as acrylate based monomers or styrene-acrylate base copolymers, in the presence of an ionic type surfactant. The polymer latex so formed may be prepared at a desired molecular weight distribution (MWD=Mw/Mn) and may, for example, contain both relatively low and relatively high molecular weight fractions to thereby provide a relatively bimodal distribution of molecular weights. Pigments may then be milled in water along with a surfactant that has the same ionic charge as that employed for the polymer latex. Release agent (e.g., a wax or mixture of waxes) including olefin type waxes such as polyethylene may also be prepared in the presence of a surfactant that assumes the same ionic charge as the surfactant employed in the polymer latex. Optionally, one may include a charge control agent.

The polymer latex, pigment dispersion and wax dispersion may then be mixed and the pH adjusted to cause flocculation. For example, in the case of anionic surfactants, acid may be added to adjust pH to neutrality. Flocculation therefore may result in the formation of a gel where an aggregated mixture may be formed with particles of about 1-2 μm in size.

Such mixture may then be heated to cause a drop in viscosity and the gel may collapse and relative loose (larger) aggregates, from about 1-25 μm, may be formed, including all values and ranges therein. For example, the aggregates may have a particle size between 3 μm to about 15 μm, or between about 4 μm to about 10 μm. In addition, the process may be configured such that at least about 80-99% of the particles fall within such size ranges, including all values and increments therein. Base may then be added to increase the pH and reionize the surfactant or one may add additional anionic surfactants. The temperature may then be raised to bring about coalescence of the particles. Coalescence is referenced to fusion of all components. The toner may then be removed from the solution, washed and dried.

It is also contemplated herein that the toner particles may be prepared by a number of other methods including mechanical methods, where a binder resin is provided, melted and combined with a wax, colorant and other optional additives. The product may then be solidified, ground and screened to provide toner particles of a given size or size range.

The resulting toner may have an average particle size in the range of 1 μm to 25 μm. The toner may then be treated with a blend of extra particulate agents, including hydrophobic fumed alumina, hydrophobic fumed small silica sized less than 20 nm, medium silica sized 40 nm to 50 nm, large fumed silica sized 70 nm to 80 nm, and titania. Treatment using the extra particulate agents may occur in one or more steps, wherein the given agents may be added in one or more steps.

The alumina ($Al_2O_3$) that may be used herein may have an average primary particle size in the range of 5 nm to 100 nm, including between 7 nm to 50 nm (largest cross-sectional linear dimension) or between 7 nm to 25 nm. In addition, the alumina may be surface treated with an inorganic/organic compound which may then improve mixing (e.g., compatibility) with organic based toner compositions. For example, the alumina may include a silane coating or other coatings, such as chloro(dimethyl)octylsilane, dimethoxy(methyl)octylsilane, or methoxy(dimethyl)octylsilane. The alumina may be present in the range of 0.01% to 1.0% by weight of the toner composition, including in the range of 0.10% to 0.50% by weight. An example of the aluminum oxide may be that available from Evonik Corporation under the tradename AEROXIDE and product number C 805.

Referring again to the extra-particulate agents that may be used herein, small silica may be understood as silica ($SiO_2$) having an average primary particle size in the range of 2 nm to 20 nm, or between 5 nm to 15 nm (largest cross-sectional linear dimension) prior to any after treatment, including all values and increments therein. The small silica may be present in the toner formulation as an extra particulate agent in the range of 0.01% to 3.0% by weight of the toner composition, such as 0.1% to 1.0% by weight, including all values and increments therein. In addition, this small silica may be treated with hexamethyldisilazane. An exemplary silica may be available from Evonik Corporation under the tradename AEROSIL and product numbers R812.

Medium sized silica may be understood as silica having a primary particle size in the range of 30 nm to 60 nm, or between 40 nm to 50 nm, prior to any after treatment, including all values and increments therein. Primary particle size may be understood as the largest linear dimension through a particle volume. The medium sized silica may be present in the toner formulation as an extra particulate agent in the range of 0.1% to 2.0% by weight of the toner composition, including all values and increments in the range of 0.1% to 2.0% by weight. The medium sized silicas may also be treated with surface additives that may impart different hydrophobic characteristics or different charges to the silica. For example, the silica may be treated with hexamethyldisilazane (silane), polydimethylsiloxane (silicone oil), etc. Exemplary silicas may be available from Evonik Corporation under the tradename AEROSIL and product numbers RX-50 or RY-50.

Large fumed silica may be understood as silica having a primary particle size in the range of 70 nm to 120 nm, or between 70 nm to 80 nm, prior to any after treatment, including all values and increments therein. The large fumed silica may be present in the toner formulation as an extra particulate agent in the range of 0.1% to 2 weight %, for example in the range of 0.25 weight % to 1 weight % of the toner composition. The large fumed silica may also be treated with surface additives that may impart different hydrophobic characteristics or different charges to the silica. For example, the large colloidal silica may be treated with hexamethyldisilazane, polydimethylsiloxane, dimethyldichlorosilane, and combinations thereof, wherein the treatment may be present in the range of 1 weight % to 10 weight % of the silica. Exemplary large silicas may be available from Evonik Corporation under the trade name VPRY40S or VPRX40S.

In addition, titania (titanium-oxygen compounds such as titanium dioxide) may be added to the toner composition as a extra particulate additive. The titania may be present in the formulation in the range of about 0.01% to 3.0% by weight of the toner formulation, such as 0.1% to 1.0%. The titania may include a surface treatment, such as aluminum oxide. The titania particles may have a mean particle length in the range of 0.1 μm to 3.0 μm, such as 0.5 μm-2.0 μm and a mean particle diameter in the range of 0.01 μm to 0.2 μm, such as 0.13 μm. An example of titania contemplated herein may include FTL-110 available from ISK USA. Other contemplated titanias may include those available from DuPont; Kemira of Finland under the product designation Kemira RODI or RDI-S; or Huntsman Pigments of Texas under the product name TIOXIDE R-XL.

The disclosed method to make the toner of the present invention operates to provide a finishing to toner particles, as more specifically described below. Such finishing may rely upon what may be described as a device for mixing, cooling and/or heating the particles which is available from Hosokawa Micron BV and is sold under the trade name "CYCLOMIX." Such device may be understood as a conical device having a cover part and a vertical axis which device narrows in a downward direction. The device may include a rotor attached to a mixing paddle that may also be conical in shape and may include a series of spaced, increasingly wider blades extending to the inside surface of the cone that may serve to agitate the contents as they are rotated. Shear may be generated at the region between the edge of the blades and the device wall. Centrifugal forces may therefore urge product towards the device wall and the shape of the device may then urge an upward movement of product. The cover part may then urge the products toward the center and then downward, thereby providing a feature of recirculation.

The device as a mechanically sealed device may operate without an active air stream, and may therefore define a closed system. Such closed system may therefore provide relatively vigorous mixing and the device may also be configured with a heating/cooling jacket, which allows for the contents to be heated in a controlled manner, and in particular, temperature control at that location between the edge of the blades and the device wall. The device may also include an internal temperature probe so that the actual temperature of the contents can be monitored.

For example, conventional toner or chemically prepared toner (CPT) may be combined with one or more extra particulate additives and placed in the above referenced conical mixing vessel. The temperature of the vessel may then be controlled such that the toner polymer resins are not exposed to a corresponding glass transition temperature or Tg which could lead to some undesirable adhesion between the polymer resins prior to mixing and/or coating with the EPA material. Accordingly, the heating/cooling jacket may be set to a temperature of less than or equal to the Tg of the polymer resins in the toner, and preferably to a cooling temperature of less than or equal to about 25° C.

The conical mixing device with such temperature control may then be operated wherein the rotor of the mixing device may preferably be configured to mix in a multiple stage sequence, wherein each stage may be defined by a selected rotor rpm value (RPM) and time (T). Such multiple stage sequence may be particularly useful in the event that one may desire to provide some initial break-up of toner agglomerates. In addition, such initial first stage of mixing may be controlled in time, such that the conical mixer operates at such rpm values for a period of less than or equal to about 60 seconds, including all values and increments therein. Then, in a second stage of mixing, the rpm value may be set higher than the rpm value of the first stage, e.g., at an rpm value greater than about 500 rpm. Furthermore, the time for mixing in the second stage may be greater than about 60 seconds, and more preferably, about 60-180 seconds, including all values and increments therein. For example, the second stage may therefore include mixing at a value of about 1300-1350 rpm for a period of about 90 seconds. Following the above mentioned blending the toner with surface additives can be subjected to a screening step or a classifying step to remove any undesired large agglomerates or particles. It may be appreciated that following the screening or classifying step the toner can be placed in the conical mixer and further blended to achieve better adhesion of the surface additives to the toner surface.

It can therefore be appreciated that with respect to the mixing that may take place in the present invention, as applied to mixing EPA with toner, such mixing may efficiently take place in multiple stages in a conical mixing device, wherein EPA may be added in a first stage wherein the breaking of aggregates may be accomplished, followed by screening, and then additional EPA added before the toner is cooled. In addition, the temperature of the mixing process may again be controlled within such multiple staged mixing protocol such that the heating/cooling jacket and/or the polymer within the toner (as measured by an internal temperature probe) is maintained below its glass transition temperature (Tg).

It has been found that the mixing of toner particulate with extra particulate additive in the conical mixing device according to the above provides a relatively more uniform surface distribution of EPA.

The extra particulate additives (EPA) may serve a variety of functions, such as to modify or moderate toner charge, increase toner abrasive properties, influence the ability/tendency of the toner to deposit on surfaces, improve toner cohesion, or eliminate moisture-induced tribo-excursions. The extra particulate additives may therefore be understood to be a solid particle of any particular shape. Such particles may be of micron or submicron size and may have a relatively high surface area. The extra particulate additives may be organic or inorganic in nature. For example, the additives may include a mixture of two inorganic materials of different particle size, such as a mixture of differently sized fumed silica. The relatively small sized particles may provide a cohesive ability, e.g. ability to improve powder flow of the toner. The relatively larger sized particles may provide the ability to reduce relatively high shear contact events during the image forming process, such as undesirable toner deposition (filming).

The examples herein are for the purposes of illustration and are not intended to be exhaustive or to limit the invention to the formulations discussed herein.

Example Toner 1

A chemically prepared styrene acrylic toner with a $1^{st}$ scan/$2^{nd}$ scan onset Tg of about 51 C/45 C respectively, and comprising of a resin with Mn~8K, Mp~20K and Mw~120K, 7% FTX-1 wax, 7% Nipex-35 carbon black pigment and 3.75% charge control agent (aluminum salicylate) was treated in a first step in a Cyclomix blender with a mixture of 0.5% Aerosil R812, 0.05% Aluoxide C805, and 0.5% FTL-110 titania, mixture of a medium sized silica (Aerosil RY50) and a fumed 70-80 nm silica that was treated with either silicone oil ('FSi-O') or silane ('FSi-Silane'). The silicone oil corresponds to polydimethylsiloxane ('PDMS') and silane corresponds to hexamethyldisilazane ('HMDS'). Toners were evaluated in a Lexmark C792 series printer printing at 50 ppm.

TABLE 1

Performance of RY50/Fumed 70-80 nm Silica in a Cold/Dry (60° F./8% RH) Environment

| Toner ID | RY50/FSi | Q/M (μC/g) | DR M/A (mg/cm$^2$) | Q/A (nC/cm$^2$) | L* across page | Toner usage/ TTC (mg/pg) | Efficiency |
|---|---|---|---|---|---|---|---|
| Comp. Example 1 | 3%/0% | −26.3 | 0.48 | −12.6 | 12.3-14.6 | 10.0/1.7 | 83% |
| Example 1a | 2%/1% FSi-HMDS | −27.6 | 0.50 | −13.8 | 12.8-14.9 | 10.4/1.7 | 83.6% |
| Example 1b | 2%/1% FSi-PDMS | −25.9 | 0.49 | −12.7 | 12.8-14.7 | 10.2/1.2 | 88.3% |
| Example 1c | 1%/2% FSi-PDMS | −22.4 | 0.49 | −10.9 | 12.7-14.6 | 10.8/0.8 | 92.6% |

FSi: Fumed 70-80 nm Silica
FSi-HMDS: Fumed 70-80 nm Silica treated with hexamethyldisilazane
FSi-PDMS: Fumed 70-80 nm Silica treated with polydimethlysiloxane

TABLE 2

Performance of RY50/Fumed 70-80 nm Silica in a Hot/Wet (78° F./80% RH) Environment

| Toner ID | RY50/FSi | Q/M (μC/g) | DR M/A (mg/cm$^2$) | Q/A (nC/cm$^2$) | L* across page | Toner usage/ TTC (mg/pg) | Efficiency |
|---|---|---|---|---|---|---|---|
| Comp. Example 1 | 3%/0% | −27.3 | 0.40 | −10.9 | 11.0-11.9 | 13.9/3.8 | 72.7% |
| Example 1a | 2%/1% FSi-HMDS | −27.1 | 0.41 | −11.1 | 11.6-12.7 | 13.5/3.5 | 74.1% |
| Example 1b | 2%/1% FSi-PDMS | −25.2 | 0.41 | −10.3 | 11.8-12.7 | 13.1/2.6 | 80.1% |
| Example 1c | 1%/2% FSi-PDMS | −22.0 | 0.42 | −9.24 | 12.1-13.0 | 14.2/2.7 | 80.9% |

FSi: Fumed 70-80 nm Silica
FSi-HMDS: Fumed 70-80 nm Silica treated with hexamethyldisilazane
FSi-PDMS: Fumed 70-80 nm Silica treated with polydimethlysiloxane The amount of particulate additives used in the Comparative Example Toner 1, 1a, 1b and 1c is kept at a total of 3%. As seen in Tables 1 and 2, decreasing the amount of RY50 and replacing it with a 70-80 nm fumed silica that has either a HMDS treatment or a PDMS surface treatment does not alter the charge per unit mass (Q/M) of the toner, if the blend ratio is 2:1. However, when the amount of 70 nm-80 nm silica is greater than the amount of RY 50, the resulting charge of the toner (Q/M) is lowered, possibly related to the dominating behavior of the 70 nm-80 nm as a spacer and distribution on the toner surface. L* corresponds to the print density measured on a page that contains 100% solids. The L* for Toners 1a, 1b and 1c are similar to the Comparative Example 1, and hence show Toner Examples 1a, 1b, and 1c retaining good print characteristics. One key metric that tends to favor the inventive mixture of the medium 40 nm-50 nm sized silica and the large 70 nm-80 nm fumed silica is the toner usage. Independent of the type of surface treatment on the fumed 70 nm-80 nm silica (i.e. HMDS or PDMS), the toner-to-cleaner (TTC) or waste toner numbers are lower than the Comparative Example 1, thereby resulting in a desirable higher toner usage efficiency. Moreover, Toners 1a, 1b or 1c did not film on any of the cartridge components such as developer roll, photoconductor or doctor blade.

Example Toner 2

While the benefits of a fumed 70 nm-80 nm has been apparent from the previous Tables, the following Tables will compare the behavior of 70 nm-80 nm silica prepared from either a fuming process or a colloidal process. Colloidal silicas are prepared as monodisperse suspensions with particle sizes ranging from approximately 30 nm to 100 nm in diameter. Polydisperse suspensions of colloidal silica can also be synthesized and have the approximate particle sizes as monodisperse suspensions. Smaller particles of silica are difficult to stabilize while particles much greater than 150 nm are subject to sedimentation. Whereas fumed silica tend to form agglomerates or aggregates, colloidal silica dispersed more uniformly and therefore produce significantly fewer agglomerates or aggregates. The toner used in this study corresponds to a chemically prepared styrene acrylic toner with a Tg of about 51 C ($1^{st}$ scan onset) and comprising of a resin with Mn~8K, Mp~20K and Mw~120K, 7% Nipex 35 black pigment, was treated with 0.5% Aerosil R812 and 0.05% Aluoxide C805, 0.5% FTL-110 titania and mixture of a medium silica (Aerosil RY50) and fumed 70 nm-80 nm silica that was treated with silicone oil (FSi-Silicone oil). So as to have a meaningful evaluation, the surface treatment for fumed and colloidal 70 nm-80 nm silica was kept similar, namely treated with silicone oil. Evaluation of the toner was carried out in a Lexmark C792 printer in a cold/dry (60° F./8% RH) and hot/wet environment (78° F./80% RH), and results are shown below:

TABLE 3

Performance of RY50/Large70 nm-80 nm Silica in a Cold/Dry (60° F./8% RH) environment

| Toner ID | RY50/Large Silica | Q/M (μC/g) | DR M/A (mg/cm$^2$) | Q/A (nC/cm$^2$) | L* across page | Toner Usage/ TTC | PC Filming/ Starve |
|---|---|---|---|---|---|---|---|
| Comp. Example 4 | 3%/0% | −24.4 | 0.39 | −9.51 | 14.5 | 11.7/1.8 | None/None |
| Example 4a | 1.5%/1.5% FSi-O (Fumed) | −23.1 | 0.42 | −9.70 | 15.4 | 9.0/1.8 | None/None |
| Example 4b | 1.5%/1.5% FSi-O (Colloidal) | −25.7 | 0.39 | −10.0 | 14.4 | 9.3/1.3 | Yes/Yes |
| Example 4c | 0%/3% FSi-O (Colloidal) | −29.7 | 0.34 | −10.1 | 20.0 | 9.8/1.9 | Yes/Yes |

FSi-O: 70 nm-80 nm Silica treated with Silicone Oil

TABLE 4

Performance of RY50/Large 70 nm-80 nm Silica in a in a Hot/Wet (78° F./80% RH) environment

| Toner ID | RY50/Large silica | Q/M (μC/g) | DR M/A (mg/cm$^2$) | Q/A (nC/cm$^2$) | L* across page | Toner Usage/ TTC | PC Filming/ Starve |
|---|---|---|---|---|---|---|---|
| Comp. Example 4 | 3%/0% | −28.3 | 0.34 | −9.6 | 13.6 | 11.8/2.5 | None/None |
| Example 4a | 1.5%/1.5% FSi-O (Fumed) | −26.3 | 0.36 | −9.5 | 13.5 | 11.7/2.2 | None/None |
| Example 4b | 1.5%/1.5% FSi-O (Colloidal) | −27.6 | 0.35 | −9.7 | 13.9 | 13.0/2.4 | None/None |
| Example 43 | 0%/3% FSi-O (Colloidal) | −29.3 | 0.32 | −9.4 | 15.6 | 17.4/7.0 | None/Yes |

FSi-O: 70 nm-80 nm Silica treated with Silicone Oil

Tables 3 and 4 show a comparison of a 70 nm-80 nm silica prepared from either a fuming or colloidal process.

Although the charge behavior is similar for the two systems, the mass on developer roll tends to decrease when colloidal 70 nm-80 nm silica is used. The toner usage that tends to favor a 70 nm-80 nm silica, is again observed for the fumed silica and colloidal at the cold/dry environment. However, in a hot/wet environment, the toner usage for a colloidal silica tends to be high, and in particular when used as a single medium size silica. Another print metric that seems to be impacted is the tendency to achieve uniform prints through life. At the 3% level, colloidal silica tends to exhibit a "starvation" phenomenon. Starvation may be described as the inherent inability of the toner to release from a developer roll following the $2^{nd}$ or $3^{rd}$ revolution of the developer roll and correspondingly the page. It is also possible that the rate of replenishment of developer roll in its $2^{nd}$ or $3^{rd}$ developer roll revolution is limited or poor and hence the printed page shows a significant decrease in print density. Due to the non-uniform replenishment, the bottom half of the page is predominantly left uncovered by toner. This defect was not observed with the 70 nm-80 nm fumed silica. Hence it is not obvious to one conversant with prior art that there can be a significant difference in performance based on the method of preparation.

Further to the observations discussed in Tables 3 and 4, the comparison of a large silica obtained via a fumed process as against a colloidal process was verified in a printer test, wherein the toner was prone to leaks in a cartridge. Toner leak described here corresponds to toner that is ejected from a cartridge as a result of high flow, low cohesivity or very high charge. Table 5 describes a test wherein the printer was run in a continuous mode at either lab ambient, cold/dry or hot/wet environment and monitored for toner leaks in a cartridge. Toner leaks in a cartridge is rated as "severe" if the toner has coated the photoconductor drum and developer roll, and rated "slight" if there is a very small amount of toner outside of the developer unit. Where the rating is "severe", there is also print quality defects observed, whereas a slight rating would result in no print quality issues. In this evaluation, toner was blended with about The toner used in this study corresponds to a chemically prepared styrene acrylic toner with a Tg of about 52 C and comprising of a resin with Mn~8K, Mp~20K and Mw~120K, 6% PY74 yellow pigment, was treated with 0.5% Aerosil R812, about 0.05% Aluoxide C805, 0.35% FTL-110 titania and mixture of a medium silica (Aerosil RY50) and fumed 70 nm-80 nm silica that was treated with silicone oil (FSi-Silicone oil). Evaluation of the toner was carried out in a Lexmark C792 printer in an ambient (72° F./40% RH), cold/dry (60° F./8% RH) and hot/wet environment (78° F./80% RH), and results are shown below:

TABLE 5

Performance of RY50/70 nm-80 nm Silica or Colloidal silica across various environments

| Toner ID | RY50/Large silica | Q/M (μC/g) (Amb/C_D/H_W) | DR M/A (mg/cm$^2$) (Amb/C_D/H_W) | Toner Usage (mg/pg) (Amb/C_D/H_W) | Toner Leaks Onset pages/ Rating |
|---|---|---|---|---|---|
| Comp. Example 5 | 0.7%/1.5% (Colloidal - Silane) | −32.3/−32.2/−32.7 | 0.40/0.47/0.37 | 8.60/10.80/12.40 | 15K/Severe |
| Example 5a | 1%/1% FSO (Fumed - Silicone oil) | −28.2/−28.4/−29.1 | 0.40/0.46/0.39 | 8.00/8.60/8.00 | 60K/Slight |

Amb: Lab Ambient
C_D: Cold/dry 60° F./8% RH
H_W: Hot/Wet 78° F./80% RH]

As can be seen in Table 5, the fumed large silica in Example 5a shows the expected decrease in toner usage, despite the slightly lower charge. Although the fumed and colloidal silica do function as spacers on the toner particle, the fumed silica appears to be more effective in mitigating toner leaks. Whereas Comparative Example 5 would have resulted in a catastrophic failure of the toner cartridge and print development, Example 5a results in a system that is more robust to the possibility of a failure, apart from achieving a higher efficiency in the toner usage.

Hence it may be seen that although the use of large silica is beneficial to act as a spacer on the toner, the type of large silica is more critical to actual performance in the cartridge or printer. Or more specifically, invention relates to use of a fumed silica that is about 70 nm or greater and in combination with a medium silica that is about 40 nm, and more preferably wherein the amount of the fumed large silica is less than the amount of medium silica.

Hence it may be concluded that the author has shown clear demonstration of the use of 70 nm-80 nm silica in an electrophotographic process. The 70 nm-80 nm is preferably obtained via a fuming a process. The use of the 70 nm-80 nm in combination with a smaller size medium silica such as 40 nm primary particle size can result in good print quality and lowering the toner usage, and more particularly lowering toner waste. Further, the said 70 nm-80 nm silica can be surface treated with either a silane coupling agent or silicone oil.

What is claimed is:

1. A method for making a toner composition comprising the steps of:

providing toner particles;

mixing medium sized fumed silica particles with the toner particles, the medium sized fumed silica particles have a primary particle size in the range of 30 nm to 60 nm and are present in the range of 0.1% to 2.0% by weight of the toner composition; and mixing large sized fumed silica particles with the toner particles and the medium sized fumed silica particles mixture, the large sized fumed silica particles have a primary particle size in the range of 70 nm to about 120 nm, and are present in the range of 0.1% to 2% by weight of the toner composition.

2. The method of claim 1, wherein the medium sized fumed silica particles are treated with a surface treatment selected from the group consisting of hexamethyldisilazane and polydimethylsiloxane.

3. The method of claim 1, wherein the large sized fumed silica particles are treated with a surface treatment selected from the group consisting of hexamethyldisilazane, polydimethylsiloxane, dimethyldichlorosilane, dimethyldiethoxysilane octyltrialkoxysilane and combinations thereof.

4. The method of claim 1, wherein the ratio of the medium sized fumed silica particles to the large sized fumed silica particles is about 95/5 to about 5/95.

5. The method of claim 4, wherein the ratio of the medium sized fumed silica particles to the large sized fumed silica particles is about 95/5 to about 50/50.

6. The method of claim 1, further comprising the step of mixing alumina particles with the toner particles, the medium sized fumed silica particles and the large sized fumed silica particles, wherein the alumina particles are present in the range of 0.01% to 1.0% by weight of the toner composition.

7. The method of claim 6, wherein the alumina particles are surface treated with octylsilane.

8. The method of claim 1, further comprising mixing small sized silica particles with the toner particles, the medium sized fumed silica particles, the large sized fumed silica particles, and the alumina particles, wherein the small sized silica particles have a primary particle size in the range of 2 nm to 20 nm and are present in the range of 0.1% to 0.5% by weight of the toner composition.

9. The method of claim 1, wherein the toner particles comprise a styrene-acrylate copolymer resin.

10. The method of claim 1, wherein the toner particles comprise a polyester resin.

11. The method of claim 1, wherein the large sized fumed silica particles are present in the range of 0.25% to 1% by weight of the toner composition.

12. The method of claim 1, wherein the large sized fumed silica particles are sized 70 nm to 80 nm.

13. A method for making a toner composition, comprising the steps of:

providing toner particles;

mixing medium sized fumed silica particles with the toner particles and the medium sized fumed silica particles have a primary particle size in the range of 30 nm to 60 nm and are present in the range of 0.1% to 2.0% by weight of the toner composition;

mixing large sized fumed silica particles with the toner particles and the medium sized fumed silica particles mixture and the large sized fumed silica particles have a primary particle size in the range of 70 nm to about 120 nm and are present in the range of 0.1% to 2% by weight of the toner composition;

mixing alumina particles with the toner particles, the medium sized fumed silica particles and the large sized fumed silica particles and the alumina particles are present in the range of 0.01% to 1.0% by weight of the toner composition: and mixing small sized silica particles having a primary particle size in the range of 2 nm to 20 nm and titania with the toner particles, the medium sized fumed silica particles, the large sized fumed silica particles and the alumina particles to form a toner composition.

14. The method of claim 13, wherein the medium sized fumed silica particles are treated with a surface treatment selected from the group consisting of hexamethyldisilazane and polydimethylsiloxane.

15. The method of claim 13, wherein the large sized fumed silica particles are treated with a surface treatment selected from the group consisting of hexamethyldisilazane, polydimethylsiloxane, dimethyldichlorosilane, dimethyldiethoxysilane octyltrialkoxysilane and combinations thereof.

16. The method of claim 13 wherein the titania is acicular titanium oxide.

* * * * *